United States Patent [19]

Morimoto et al.

[11] Patent Number: 4,770,310

[45] Date of Patent: Sep. 13, 1988

[54] CASING FOR DISPLAY DEVICE

[75] Inventors: Kiyoshi Morimoto; Shigeo Itoh; Hiroshi Watanabe; Mikio Yokoyama; Takeshi Tonegawa, all of Mobara, Japan

[73] Assignee: Futaba Denshi Kogyo K.K., Mobara, Japan

[21] Appl. No.: 818,767

[22] Filed: Jan. 14, 1986

Related U.S. Application Data

[63] Continuation-in-part of Ser. No. 627,531, Jul. 3, 1984, Pat. No. 4,582,210.

[30] Foreign Application Priority Data

Jul. 5, 1983 [JP] Japan ..... 58-103527

[51] Int. Cl.[4] ..... H01K 3/22

[52] U.S. Cl. ..... 220/2.2; 313/567; 313/573

[58] Field of Search ..... 220/2.2; 313/567, 573

[56] References Cited

U.S. PATENT DOCUMENTS

| | | | |
|---|---|---|---|
| 2,141,905 | 12/1938 | Fonda et al. | 313/573 X |
| 2,241,968 | 5/1941 | Suits | 220/2.2 X |
| 2,280,048 | 4/1942 | Schwarze | 220/2.2 X |
| 2,887,737 | 5/1959 | Prescott | 220/2.2 X |
| 3,493,805 | 2/1970 | Bass | 313/567 X |
| 4,582,210 | 4/1986 | Morimoto et al. | 220/2.2 |

*Primary Examiner*—Steven M. Pollard

*Attorney, Agent, or Firm*—Oblon, Fisher, Spivak, McClelland & Maier

[57] ABSTRACT

A casing for a display device of the tipless type is disclosed which is capable of being readily manufactured, and allowing a display device to have a good space factor and exhibit excellent display characteristics. The casing comprises a casing body formed with an evacuation hole and a planar plate lid member arranged to sealingly close the evacuation hole by means of a sealer when the casing is evacuated.

9 Claims, 3 Drawing Sheets

CASING FOR DISPLAY DEVICE

This is a continuation-in-part application of Ser. No. 627,531 filed July 3, 1984, now U.S. Pat. No. 4,582,210.

BACKGROUND OF THE INVENTION

1. Field of the Invention

This invention relates to a casing for a display device such as a fluorescent display device, and more particularly to a casing for a display device of the tipless type that an evacuation tube is not used.

2. Description of the Prior Art

A fluorescent display device comprises a casing evacuated to high vacuum of about $1\times10^{-5}-1\times10^{-7}$ Torr and an electrode assembly including cathodes for emitting electrons therefrom, phosphor-deposited anodes arranged on conductors, control electrodes for carrying out the acceleration and/or control of electrons emitted from the cathodes and the like. In general, a casing for a fluorescent display device has an evacuation tube of glass inserted into an evacuation hole, through which the casing is evacuated to a high vacuum. The evacuation tube is then sealed by melting when the casing is evacuated to a high vacuum therethrough.

However, the conventional casing has a disadvantage of causing a display device to have a low space factor, because the tip tube remains projected outwardly from the casing after it is sealed. Also, the tip tube is formed of glass inferior in impact resistance, resulting in the fluorescent display device being inferior in durability.

In view of the foregoing, casings for a fluorescent display device of the tipless type have been proposed which are constructed in a manner as shown in FIGS. 1 and 2. In the casing shown in FIG. 1, a glass substrate A is formed with a through-hole B and a ceramic element D is bonded onto the inner surface of the through-hole B by means of frit glass C. The ceramic element D is formed with a through-hole E of a smaller diameter substantially concentric with the through-hole B, and a metallized layer F is deposited on the inner side surface of the through-hole E and on the surface portion of the ceramic element D adjacent to the through-hole E and opposite to the through-hole B. The hermetic sealing of the casing is carried out by heating the vicinity of the through-hole E to melt a brazing material G filled in the through-hole E. After the casing is evacuated, material G is filled in the through-hole E.

Another conventional casing for a tipless fluorescent display device has been proposed, which is constructed as shown in FIG. 2.

More particularly, a casing shown in FIG. 2 includes a glass substrate 1 constituting a part of the casing, on an upper surface of which anode conductors 2, insulating layers 3 and phosphor layers 4 are deposited in order. The anode conductors 2 each are formed of an Al film into a stripe shape or formed of a light-permeable material such as a transparent conductuve film or the like, so that the luminous display of a fluorescent display device may be observed through the substrate 1.

Stretched above the substrate 1 are filamentary cathodes 5 for emitting thermions thereform. Also, between the filamentary cathodes 5 and the substrate 1 are arranged control electrodes 6 which serve to carry out the acceleration and/or control of acceleration of the thermions to impinge them on the phosphor layers 4, to thereby cause the fluorescent display device to carry out a desired luminous display.

Reference numerals 7 and 8 respectively designate an upper plate and side plates which form the casing in cooperation with the substrate 1, and the substrate 1, upper plate 7 and side plates are integrally assembled by means of a sealer 11 formed of low-melting frit glass or the like. The upper plate 7 is formed with an evacuation hole *7a*. The fluorescent display device constructed as described above is placed in an evacuating apparatus (not shown), which is then evacuated to desired vacuum to evacuate the casing through the exhaust vent *7a*. The sealing of the evacuation hole *7a* is carried out in a manner to heat the overall casing to subject it to a sufficient baking treatment, pressedly arrange a lid member 10 on which a sealer 9 formed of low-melting frit glass or the like was previously deposited and which was then calcined in an ambient atmosphere around the evacuation hole *7a*, and heat the lid member 10 to a temperature sufficient to melt the sealer 9, to thereby seal the evacuation hole *7a*.

However, the conventional casings of such construction have not been put into practice due to the following disadvantages.

One of the disadvantages in the casing shown in FIG. 1 is that the casing is hard to manufacture and complicated in structure because it is required to form the hard to work ceramic element with the through-hole E and also it is necessary to fix the ceramic element D with respect to the through-hole B of the glass substrate A from the inside of the casing in a specific atmosphere.

Another disadvantage is that a vapor of metal generated from the brazing material G and gas generated from organic flux by heating remain in the casing not only to be reactively absorbed in an oxide cathode to cause sintering, to thereby hinder the electron discharging capacity of the cathode but to cause the decrease in vacuum within the casing and the contamination of the surface of a fluorescent layer to decrease display characteristics of the fluorescent display device, because the through-hole E of the substrate A is sealedly filled with the bracing material G by melting.

The conventional casing shown in FIG. 2 accomplishes the simplication of the manufacturing process but fails to effectively control or regulate the positional relationship of the sealer 9 to the evacuation hole *7a* during the sealing of the hole. Accordingly, it does not prevent the sealer 9 from flowing into the evacuation hole *7a* so that decomposition gas of the sealer and the like may be generated during the sealing and then adsorbed on the cathodes 5 as indicated by arrows a in FIG. 2, as in the casing shown in FIG. 1. Thus, the casing likewise has a disadvantage of decreasing the electron emitting capability of the cathodes and causing the contamination of surface of the phosphor layers 4 to substantially deteriorate the display characteristics of the fluorescent display device.

SUMMARY OF THE INVENTION

The present invention has been made in view of the foregoing disadvantages of the prior art.

Accordingly, it is an object of the present invention to provide a casing for a display device of the tipless type which is simple in construction and readily manufactured.

It is another object of the present invention to provide a casing for a display device of the tipless type which does not decrease the display characteristics of the display device.

It is further object of the present invention to provide a casing for a display device of the tipless type which is capable of regulating a position of a sealer arranged with respect to an evacuation hole of the casing to minimize or substantially prevent the adhesion of decomposition gas or gas generated due to the decomposition of the sealer and vaporized material onto elements for a display device arranged in the casing, to thereby effectively prevent a decrease in the display characteristics of a fluorescent display device.

In accordance with the present invention, there is provided a casing for a display device having an evacuation hole formed at a part thereof and sealed with a flat lid member by means of a sealer to form a specific atmosphere therein, wherein the sealer to be used is arranged at a position spaced from an end of the evacuation hole to a degree sufficient to meet a relationship of $l \geqq (d/t)h$ wherein h is a thickness of the sealer, l is a distance from the end of the evacuation hole of the sealer, d is a diameter of the evacuation hole and t is a wall thickness of the casing.

BRIEF DESCRIPTION OF THE DRAWINGS

Other objects and many of the attendant advantages of the present invention will be readily appreciated as the same becomes better understood by reference to the following detailed description when considered in connection with the accompanying drawings in which like reference characters designate the same parts throughout, wherein.

DETAILED DESCRIPTION OF THE PREFERRED EMBODIMENTS

Now, a casing for a display device of the tipless type according to the present invention will be described with reference to FIGS. 3 to 6.

The following description will be made in connection with a casing for a fluorescent display device of the tipless type. However, it is a matter of course that the present invention is not limited to such a casing for a fluorescent display device.

Figure 1:
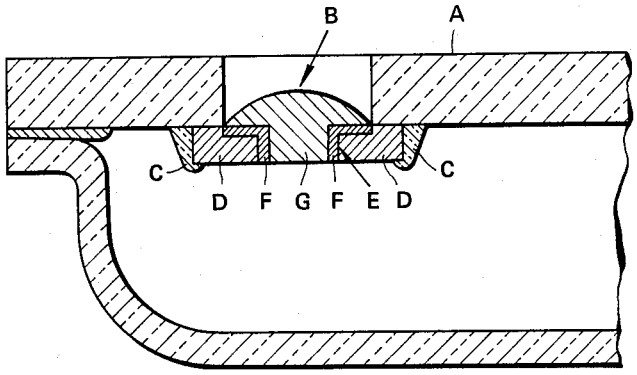
FIG.1 (PRIOR ART)
FIGS. 1 and 2 each are a fragmentary vertical sectional view showing the essential part of a conventional casing for a fluorescent display device of the tipless type.
Figure 3:
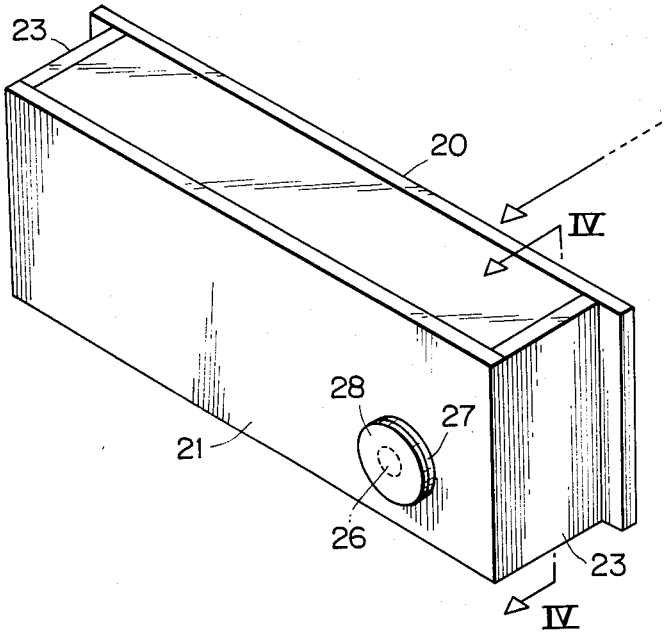
FIG. 3 is a perspective view showing a first embodiment of a casing for a display device of the tipless type according to the present invention.
Figure 4:
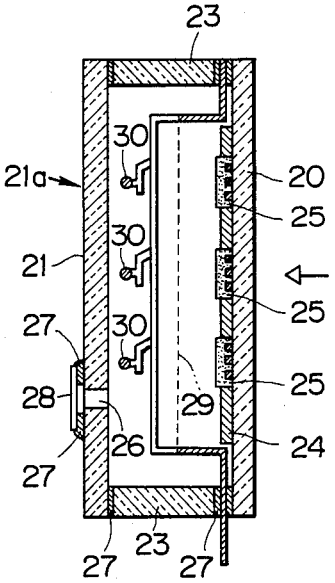
FIG. 4 is a vertical sectional view taken along line IV—IV of FIG. 3.

FIG. 3 is a rear perspective view of a casing for a fluorescent display device of the tipless type which is a first embodiment of the present invention, and FIG. 4 is a sectional view taken along line IV—IV of FIG. 3. The casing for a fluorescent display device shown in FIGS. 3 and 4 includes a casing body comprising a substrate 20 and a rear cover 21 each formed of an insulating plate material such as a glass plate and side plates 23 peripherally arranged between the substrate and the rear cover 21, which are sealedly bonded together by a sealer 26 as shown in FIG. 4.

The rear cover 21 is provided with a planar exterior surface and formed at any portion thereof with a through-hole or evacuation hole 26 for communicating the exterior of the rear cover 21 with the interior of the casing body. In the illustrated embodiment, the evacuation hole 26 is provided at the corner portion of the rear cover 21. The evacuation hole 26, as shown in FIG. 4, is sealedly closed by a planar plate lid member 28 by means of the sealer 27 applied to the exterior surface 21*a* of the rear cover 21, to thereby keep the interior of the casing body at a high vacuum when it is evacuated.

A material suitable for the sealer 27 used for bonding the plate lid member 28 to the rear cover 21 includes various solder materials such as low-melting solder mainly consisting of lead oxide (PbO) and high-melting solder mainly consisting of $Al_2O_3$ and CaO. In the illustrated embodiment, the sealer 27 is formed of low-melting solder comprising low-melting amorphous glass mainly consisting of PbO. The sealer 27 used for bonding the lid member 28 to the rear cover 21 is the same as that used to bond the glass substrate 20, rear cover 21 and side plates 23 together to form the casing body in the illustrated embodiment and conventionally used in the art. It is well known in the art that such a sealer provides sufficient bonding strength and sealing properties when glass plates are bonded to each other.

Above the substrate 20 are stretched filamentary cathodes 30 for emitting thermions therefrom. Between the substrate 20 and the filamentary cathodes 30 are arranged control electrodes 29 which serve to carry out the acceleration and/or control of acceleration of electrons emitted from the filamentary cathodes 30 to impinge them on phosphors 25, to thereby cause the fluorescent display device to effect a desired luminous display.

The lid member 28 may be formed into any suitable shape such as circle, rectangle or the like so long as it is flat and has sufficient adhesion strength. Also, the lid member 28 may be made of any suitable material such as metal, glass, ceramic or the like so long as it has a coefficient of thermal expansion substantially equal to that of the rear cover 21 and is hermetically bonded to the rear cover 21 through the sealer 27 with sufficient bond strength. Nevertheless, the lid member 28 is preferably made of a metal plate in the light of its strength. Also, the use of a metal plate for the lid member 28 is advantageous in that the thickness of the lid member 28 is highly decreased to significantly improve the space factor of a fluorescent display device. For example, when the sealer 27 is formed of low-melting frit glass, 426 alloy (Ni 42%, Cr 6%, Fe balance) is conveniently used for the lid member 28.

In the illustrated embodiment, the sealer 27 used for hermetically bonding the lid member 28 to the rear cover 21 is arranged at a position out of sight by upper and lower ends of the evacuation hole 26, as viewed from the inside of the casing. More particularly, the sealer 27 is deposited at a position on the rear cover 21 spaced from an end of an inner edge of the evacuation hole 26 to a degree sufficient to meet a relationship of $l \geqq (d/t)h$, wherein h is a thickness of the sealer 27, l is a distance from the end of the evacuation hole 26 to the inner surface of the sealer 27, d is a diameter of the evacuation hole 26 and t is a thickness of the rear cover 21. In general, the thickness h of the sealer 27, in the light of the peel strength and airtightness of the lid member 28 with respect to the rear cover 21, is preferably between about 20 μm and 200 μm, irrespective of the diameter of the evacuation hole 26 and the thickness t of the upper plate 27. Thus, supposing that the thickness t of the rear cover is 2 mm and the diameter d of the evacuation hole 26 is 3 mm as in a typical fluorescent display device, the distance l between the end of the evacuation hole 26 and the inner surface of the sealer 27 will be determined at 30 μm–300 μm. However, excessive distance l causes the inner diameter of the sealer 27 at the sealing portion to be increased to increase an exposed area of the sealer 27 in the casing, resulting in the generation of composition gas and vaporized material in the casing being increased. Also, this causes the size of the lid member 28 to be excessively increased. Thus, the distance is preferably determined at a value in proximity to the utmost limit for meeting the relationship of $l \geqq (d/t)h$.

Figure 5:
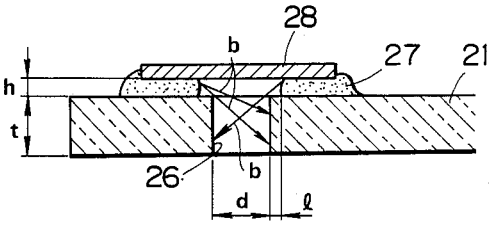
FIG. 5 is a vertical sectional view showing the essential part of the first embodiment shown in FIGS. 3 and 4.

Accordingly, in the casing of the illustrated embodiment constructed as described above, decomposition gas and vaporized material discharged from the sealer 27 during the sealing are intercepted by the surface of the evacuation hole 26 to be prevented from flowing directly into the casing, as indicated at arrows b in FIG. 5. Thus, the casing of the illustrated embodiment permits the amount of decomposition gas and vaporized material flowing into the casing to be minimized by being limited to that repeatedly reflected on the inner surface of the lid member and/or the surface of the evacuation hole 26 several times.

A second embodiment of a casing for a display device of the tipless type according to the present invention will now be described with reference to FIG. 6.

Figure 6:
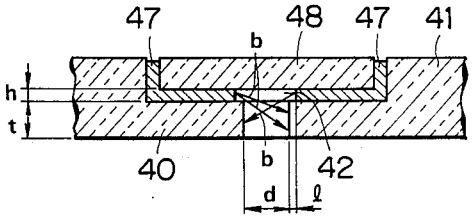
FIG. 6 is a vertical sectional view showing the essential part of a second embodiment of a casing for a display device of the tipless type according to the present invention.

In the second embodiment shown in FIG. 6, a rear cover 41 of a casing body is formed at the outer surface thereof with a recess 42 which is concentric with an evacuation hole and in communication therewith. The recess 42 is formed to have a depth and a configuration sufficient to receive a plate lid member 48 therein. A sealer 47 as in the first embodiment described above is previously applied to the recess 42, the lid member 48 subjected to preliminary calcination is received in the recess 42 to assemble a casing, and the casing thus assembled is placed in an evacuation system to allow the lid member 48 to sealingly close the evacuation hole 46. The second embodiment, as shown in FIG. 6, is adapted to apply the sealer 47 to the bottom and side sufaces of the lid member 48 except the portion facing the evacuation hole, to firmly sealingly fix the lid member 48 in the recess 42. As is apparent from the foregoing, the second embodiment can substantially reduce the thickness of a casing because the lid member 48 is sealedly received in the recess 42 to prevent the lid member 48 from projecting from the outer surface of the rear cover 41.

Figure 2:
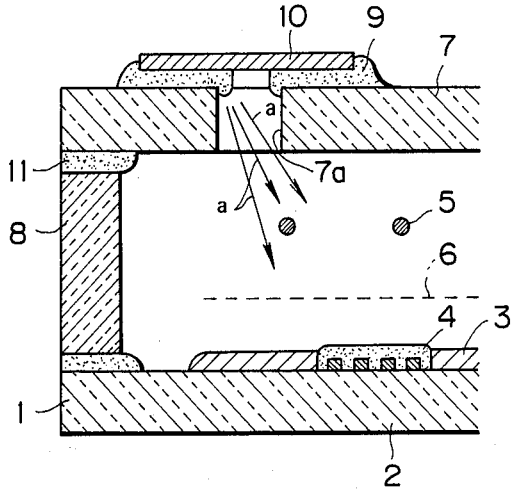
FIG.2 (PRIOR ART)
Figure 7:
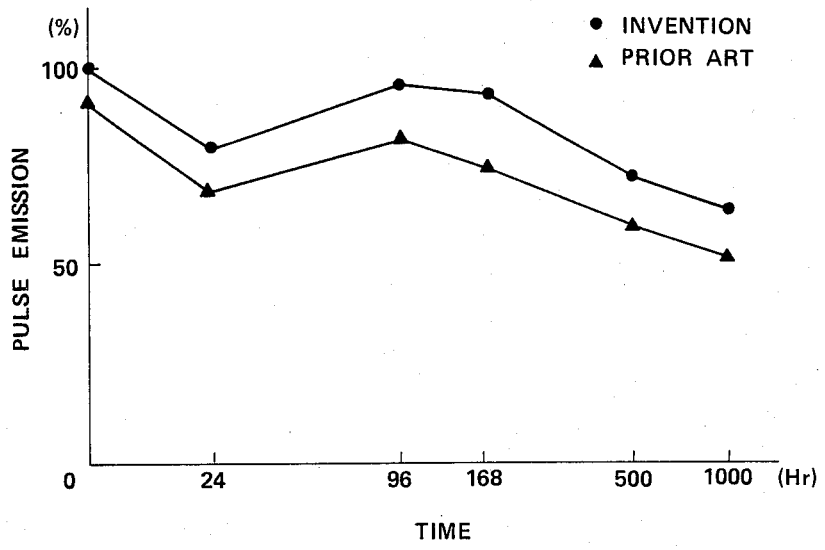
FIGS. 7 and 8 each are a graphical representation showing the comparison in display characteristics between a display device using a casing according to the present invention and that using a conventional casing.
Figure 8:
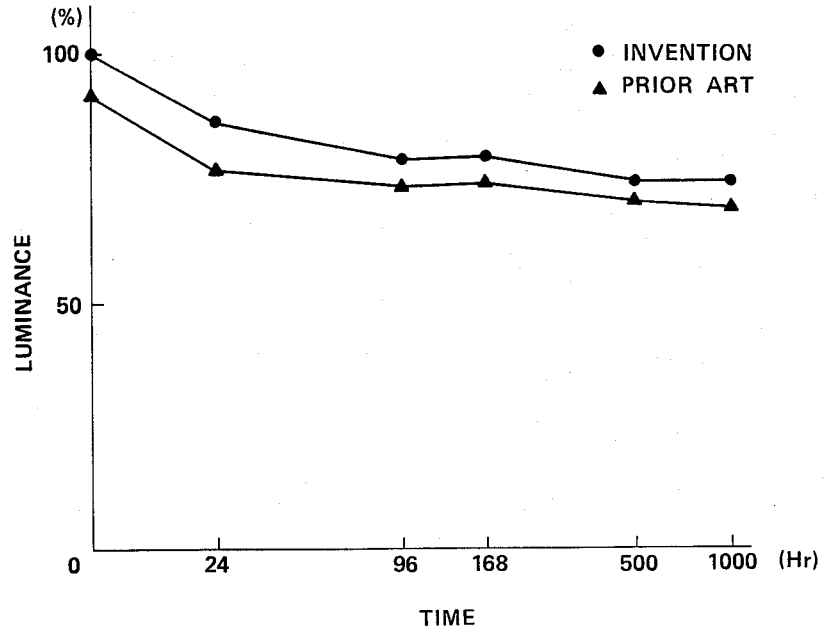

FIGS. 7 and 8 each show the comparison in display characteristics between a fluorescent display device using the casing of the present invention and that using such a conventional casing as shown in FIG. 2, which were obtained by operating both fluorescent display devices under the same conditions.

FIG. 7 shows the comparison in a time series variation of pulse emission or electron discharge capability between the two. As is apparent therefrom, the fluorescent display device using the casing of the present invention is improved by 9% in the initial characteristics and about 14% in the characteristics after the lapse of 1000 hours as compared with that using the conventional casing. Also, in the fluorescent display device using the casing of the present invention, pulse emission after 1000 hours is decreased to about 64% based on the initial value, whereas in that using the conventional casing, it is decreased to about 50%. Thus, it will be noted that the former is superior to the latter in a decrease in pulse emission as well.

FIG. 8 shows the comparison in a time series variation of luminance between the two. As indicated in FIG. 8, the fluorescent display device using the casing of the present invention is improved by about 5% in initial luminance and about 8% in luminance after 1000 hours, as compared with that using the conventional casing. Also, in the former, the luminance after 1000 hours is decreased to about 77% based on the initial value, whereas in the latter, it is decreased to about 74%.

Thus, it will be noted that the casing of the illustrated embodiment substantially prevents vaporized material and composition gas generated from the sealer 27 during the sealing step from adversely affecting the filamentary cathodes 30, phosphors 24 and the like arranged therein, as compared with the conventional one shown in FIG. 2 wherein the sealer 9 is deposited to be able to enter into the evacuation hole 7*a*, because the vaporized material and decomposition gas almost adhere onto the inner surface of the lid member 28 and the surface of the evacuation hole 26 to minimize the flowing into the casing.

As can be seen from the foregoing, the casing of the present invention is so constructed that the sealer for sealing the lid member to the casing is deposited at a position spaced from the end of the evacuation hole of the casing by a predetermined distance to cause the sealer to be out of sight as viewed from the inside of the casing. Thus, the present invention minimizes the flowing of vaporized material and decomposition gas generated from the sealer during the sealing into the casing, to thereby provide a casing for a display device which is capable of effectively eliminating the disadvantages due to the adhesion of the vaporized material and decomposition gas onto the elements arranged in the casing, such as deterioration in display characteristics of a display device.

Also, the casing of the present invention is the tipless type, so that it may effectively exhibit the abovedescribed advantages obtained by a tipless casing.

While a preferred embodiment of the invention has been described with a certain degree of particularity with reference to the drawings, obvious modifications and variations are possible in the light of the above teachings. It is therefore to be understood within the scope of the appended claims, the invention may be practiced otherwise than as specifically described.

What is claimed as new and desired to be secured by Letters Patent of the U.S. is:

1. A fluorescent display device having an improved casing, said display device comprising:

(a) a casing body containing an evacuated chamber, said casing body comprising a rear cover having an evacution hole extending from an exterior opening in the exterior surface of said rear cover to said evacuated chamber, said rear cover having a planar exterior surface surrounding said exterior opening of said evacuation hole, said evacuation hole being used during assembly of the fluorescent display device to evacuate said evacuated chamber;

(b) means for generating fluorescent light disposed in said evacuation chamber; and (c) a planar plate lid member which overlies said evacuation hole and extends radially outwardly therefrom in parallel spaced relationship to said planar exterior surface surrounding said exterior opening of said evacuation hole;

(d) a sealer applied applied between said planar plate lid member and said planar exterior surface of said glass plate surrounding said exterior opening of said evacuation hole, an inner edge of said sealer being disposed at a position spaced from an end of said evacuation hole to a degree sufficient to meet a relationship of $l \geqq (d/t)h$ wherein h is a thickness of said sealer, l is a distance from the end of said evacuation hole to said inner edge of said sealer, d is a diameter of said evacuation hole and t is a wall thickness of said casing;

whereby, during assembly of the fluorescent display device, said evacuated chamber is evacuated through said evacuation hole, after which said planar plate lid member is fixed in position by melting said sealer, said relationship existing during melting of said sealer and after said plate lid member is fixed in position.

2. A fluorescent display device as recited in claim 1 wherein said planar plate lid member is cylindrical in shape.

3. A fluorescent display device as recited in claim 1 wherein said sealer is a low-melting solder consisting essentially of lead oxide (PbO).

4. A fluorescent display device as recited in claim 1 wherein said sealer is a high-melting solder consisting essentially of $Al_2O_3$ and CaO.

5. A fluorescent display device as recited in claim 1 wherein said sealer has a thickness between 20 $\mu$m and 200 $\mu$m.

6. A fluorescent display device as recited in claim 1 wherein said planar plate lid member is formed of one from the group consisting of glass and a ceramic mainly consisting of an oxide.

7. A fluorescent display device as recited in claim 1 wherein said planar plate lid member is formed of a metal material.

8. A fluorescent display device as recited in claim 1 wherein said rear cover is formed at the outer surface thereof with a recess which is concentric with said evacuation hole and in communication therewith, said recess having a depth and a configuration sufficient to receive said planar plate lid member therein.

9. A fluorescent display device as recited in claim 1 wherein $l=(d/t)h$.

* * * * *